US011631938B2

(12) United States Patent
Jha

(10) Patent No.: US 11,631,938 B2
(45) Date of Patent: Apr. 18, 2023

(54) MULTI-BAND TUNABLE STRIP ANTENNA WITH DYNAMIC BANDWIDTH SELECTION

(71) Applicant: Eagle Technology, LLC, Melbourne, FL (US)

(72) Inventor: Uma S. Jha, Indian Harbour Beach, FL (US)

(73) Assignee: Eagle Technology, LLC, Melbourne, FL (US)

( * ) Notice: Subject to any disclaimer, the term of this patent is extended or adjusted under 35 U.S.C. 154(b) by 8 days.

(21) Appl. No.: 17/069,528

(22) Filed: Oct. 13, 2020

(65) Prior Publication Data

US 2022/0115788 A1 Apr. 14, 2022

(51) Int. Cl.
*H01Q 9/06* (2006.01)
*H01Q 5/50* (2015.01)

(52) U.S. Cl.
CPC ..... *H01Q 9/065* (2013.01); *H01Q 5/50* (2015.01)

(58) Field of Classification Search
CPC ..... H01Q 9/065; H01Q 5/50; H01Q 1/288; H01Q 15/161; H01Q 1/1235; H01Q 15/168; H01Q 1/08; H01Q 15/141; H01Q 15/16; H01Q 1/085; H01Q 21/24; H01Q 1/10; H01Q 1/12; H01Q 1/243; H01Q 13/02; H01Q 15/147; H01Q 1/14; H01Q 1/24; H01Q 15/14; H01Q 15/162; H01Q 1/1228; H01Q 1/36; H01Q 1/38; H01Q 1/48; H01Q 11/105; H01Q 15/144; H01Q 15/163; H01Q 15/165; H01Q 15/244; H01Q 19/10; H01Q 9/0428; H01Q 9/34; H01Q 9/36; H01Q 19/13; H01Q 19/134; H01Q 19/193; H01Q 21/062; H01Q 3/2617; H01Q 3/2658; H01Q 9/0407; H01Q 1/04; H01Q 1/081; H01Q 1/103; H01Q 1/1242; H01Q 1/1257; H01Q 1/27; H01Q 1/28; H01Q 1/32; H01Q 1/34; H01Q 1/362; H01Q 1/50; H01Q 1/526; H01Q 11/08; H01Q 13/00; H01Q 13/10; H01Q 13/22; H01Q 13/24; H01Q 15/148; H01Q 15/246; H01Q 19/04; H01Q 19/175;

(Continued)

(56) References Cited

U.S. PATENT DOCUMENTS 6,825,818 B2 11/2004 Toncich
2009/0073076 A1* 3/2009 Skarp ..... H01Q 1/243 343/860

(Continued)

*Primary Examiner* — Dimary S Lopez Cruz
*Assistant Examiner* — Jesus E Cano
(74) *Attorney, Agent, or Firm* — Fox Rothschild LLP; Robert J. Sacco; Carol E. Thorstad-Forsyth

(57) ABSTRACT

Systems and methods for operating an antenna assembly. The methods comprise: receiving a first command for tuning the antenna assembly to a first frequency selected from a plurality of different frequencies to which a strip antenna of the antenna assembly is tunable; selectively connecting ground to the strip antenna at a first location along an elongated length of the strip antenna; and connecting a transceiver to the strip antenna at a second location along the elongated length of the strip antenna using a first tank circuit of a plurality of tank circuits provided with the antenna assembly. The tank circuits are respectively associated with the different frequencies to which the strip antenna is tunable. The first tank circuit is associated with the first frequency to which the strip antenna is to be tuned.

21 Claims, 11 Drawing Sheets

(58) Field of Classification Search
CPC .. H01Q 19/18; H01Q 19/185; H01Q 21/0037; H01Q 21/20; H01Q 21/22; H01Q 21/245; H01Q 21/29; H01Q 3/08; H01Q 3/10; H01Q 3/14; H01Q 3/2605; H01Q 5/10; H01Q 5/25; H01Q 7/02; H01Q 7/06; H01Q 7/08; H01Q 9/0414; H01Q 9/16; H01Q 9/22; H01Q 9/28; H01Q 9/30; H01Q 9/38; H01Q 9/40; H01Q 9/44; H01Q 1/084; H01Q 1/106; H01Q 1/1207; H01Q 1/125; H01Q 1/20; H01Q 11/086; H01Q 13/0283; H01Q 19/17; H01Q 21/0056; H01Q 21/28; H01Q 25/007; H01Q 3/20; H01Q 3/267; H01Q 3/44; H01Q 5/35; H01Q 21/30; H01G 7/06; H01L 27/0808; H01P 1/203; H01P 1/20336; H01P 1/20363; H01P 1/20381; H01P 1/2039; H01P 1/2056; H01P 1/213; H01P 5/04; G01R 27/2694; H03F 1/56; H03F 2200/111; H03F 2200/294; H03F 2200/372; H03F 3/191; H04B 1/0053; H04B 1/0458; H04B 1/30; H04B 1/40; H03J 5/246; H03B 5/04; H03B 5/124; H03B 5/1262; H03B 5/1293; H03B 5/1841; H03B 5/362; H03H 7/0123; H03H 7/12; H03H 7/20; H03L 1/022; H03L 7/18
See application file for complete search history.

(56) References Cited

U.S. PATENT DOCUMENTS

| | | | | |
|---|---|---|---|---|
| 2013/0203364 | A1* | 8/2013 | Darnell | H01Q 1/243 455/90.3 |
| 2016/0173039 | A1* | 6/2016 | Frei | H03F 1/0288 29/831 |
| 2018/0076376 | A1* | 3/2018 | Brady | H01Q 1/38 |
| 2019/0184159 | A1* | 6/2019 | Yeh | A61N 1/3754 |

* cited by examiner

Go to FIG. 9B

MULTI-BAND TUNABLE STRIP ANTENNA WITH DYNAMIC BANDWIDTH SELECTION

BACKGROUND

Statement of the Technical Field

The present disclosure relates generally to communication devices. More particularly, the present disclosure relates to multi-band strip antennas with dynamic bandwidth selection.

DESCRIPTION OF THE RELATED ART

Arial vehicles (e.g., airplanes and satellites) need numerous antennas for various purposes (e.g., radio communication, radar, Electronic Warfare (EW), location tracking, navigation, etc.). These antennas must fit into a constrained volume of the vehicle, and take valuable real estate from payloads (e.g., weapons) that are essential for efficient and effective mission performance.

Some conventional platforms use an antenna for each band. In order to mitigate real estate issues, these antennas are stacked on top of each other and separated from each other by a lossy substrate. The lossy substrate reduces the efficiency of the antennas, adds weight to the aperture assembly, and adds manufacturing complexity to the aperture assembly due to isolation of via and feed through.

SUMMARY

The present disclosure concerns implementing systems and methods for operating an antenna assembly. The methods comprise receiving a command for tuning the antenna assembly to a first frequency selected from a plurality of different frequencies to which a strip antenna structure of the antenna assembly is tunable. The strip antenna structure comprises a trace formed on a substrate. In response to the command, ground is selectively connected to the strip antenna structure at a first location along an elongated length of the trace. A transceiver is connected to the strip antenna structure at a second location along the elongated length of the trace using a first tank circuit of a plurality of tank circuits provided with the antenna assembly. The tank circuits are respectively associated with the plurality of different frequencies to which the strip antenna structure is tunable. The first tank circuit is associated with the first frequency to which the strip antenna structure is to be tuned.

In some scenarios, the methods also comprise connecting ground to the strip antenna structure at a third location along the elongated length of the strip antenna structure by using a second tank circuit of the plurality of tank circuits provided with the antenna assembly. The ground connections can be made when the trace extends away from the third location in two opposing directions. The strip antenna structure may be tuned to a frequency lower than the first frequency by disconnecting ground from the third location along the elongated length of the trace. Alternatively, the transceiver is connected to the strip antenna structure at a fourth location along an elongated length of the trace so as to simultaneously provide two dipole antennas using a single trace formed on the substrate.

In those or other scenarios, the methods comprise tuning the strip antenna structure to a second frequency selected from the plurality of different frequencies to which the strip antenna structure is tunable. This frequency tuning is achieved by: disconnecting ground from the strip antenna structure at the first location along the elongated length of the trace; disconnecting the transceiver from the strip antenna structure at the second location along the elongated length of the trace; connecting ground to the strip antenna structure at the second location along the elongated length of the trace; and connecting the transceiver to the strip antenna structure at a third location along the elongated length of the trace using a second tank circuit of the plurality of tank circuits. The strip antenna structure may be tuned to a frequency lower than the second frequency by disconnecting ground from the strip antenna structure at the second location along the elongated length of the trace.

In those or other scenarios, the tank circuits may comprise a plurality of selectable sub-circuits respectively associated with different bandwidths to which the strip antenna structure is tunable. Accordingly, the methods may comprise: receiving a command for tuning the antenna assembly to a first bandwidth selected from a plurality of different bandwidths to which the strip antenna structure is tunable; and selecting a first LC circuit from a plurality of LC circuits of the first tank circuit based on the command for bandwidth tuning, the plurality of LC circuits of the first tank circuit being associated with the plurality of different bandwidths to which the strip antenna structure is tunable. Notably, the command for frequency tuning and the command for bandwidth tuning may be separate commands or comprises a single command. The transceiver is connected to the strip antenna structure at the second location along the elongated length of the trace through the at least one first LC circuit of the first tank circuit.

The methods may also comprise: receiving an additional command for tuning the antenna assembly to a second bandwidth selected from the plurality of bandwidths to which the strip antenna structure is tunable; selecting a second LC circuit from the plurality of LC circuits of the first tank circuit based on the this command; disconnecting the transceiver from the first LC circuit of the first tank circuit; and connecting the transceiver to the second LC circuit of the first tank circuit.

The present document also concerns system with an antenna assembly. The system comprises: a substrate with a plurality of vias formed therein; a strip antenna structure comprising a trace disposed on a first surface of the substrate; a ground layer disposed on a second opposing surface of the substrate; a plurality of conductive elements extending through the vias of the substrate so as to be respectively coupled between the trace and a plurality of tank circuits; and a control circuit. The controller is configured to: receive a command for tuning the antenna assembly to a first frequency selected from a plurality of different frequencies to which a strip antenna structure is tunable; cause ground to be connected to the strip antenna structure at a first location along an elongated length of the trace, responsive to the command; and cause a transceiver to be connected to the strip antenna structure at a second location along the elongated length of the trace via a first tank circuit of the plurality of tank circuits. The tank circuits are respectively associated with the plurality of different frequencies to which the strip antenna structure is tunable. The first tank circuit is associated with the first frequency to which the strip antenna structure is to be tuned.

In some scenarios, the controller is also configured to cause ground to be connected to the strip antenna structure at a third location along the elongated length of the trace via a second tank circuit of the plurality of tank circuits. This ground connection can be made when the trace extends away from the third location in two opposing directions. The controller may further be configured to: tune the strip antenna structure to a frequency lower than the first frequency by causing ground to be disconnected from the third location along the elongated length of the trace; and/or cause the transceiver to be connected to the strip antenna structure at a fourth location along an elongated length of the trace so as to simultaneously provide two dipole antennas using a single trace formed on the substrate.

In those or other scenarios, the controller is configured to tune the strip antenna structure to a second frequency selected from the plurality of different frequencies to which the strip antenna structure is tunable. This frequency tuning is caused by: disconnecting ground from the strip antenna structure at the first location along the elongated length of the trace; disconnecting the transceiver from the strip antenna structure at the second location along the elongated length of the trace; connecting ground to the strip antenna structure at the second location along the elongated length of the trace; and connecting the transceiver to the strip antenna structure at a third location along the elongated length of the trace using a second tank circuit of the plurality of tank circuits.

In those or other scenarios, the controller is configured to tune the strip antenna structure to a frequency lower than the second frequency by causing ground to be disconnected from the strip antenna structure at the second location along the elongated length of the trace. The controller may also be configured to: receive a command for tuning the antenna assembly to a first bandwidth selected from a plurality of different bandwidths to which the strip antenna structure is tunable; and select a first LC circuit from a plurality of LC circuits of the first tank circuit based on the command for bandwidth tuning, the plurality of LC circuits of the first tank circuit being associated with the plurality of different bandwidths to which the strip antenna structure is tunable. The transceiver is connected to the strip antenna structure at the second location along the elongated length of the trace through the at least one first LC circuit of the first tank circuit.

In those or other scenarios, the controller is further configured to: receive a command for tuning the antenna assembly to a second bandwidth selected from the plurality of bandwidths to which the strip antenna structure is tunable; select a second LC circuit from the plurality of LC circuits of the first tank circuit based on the this command; cause the transceiver to be disconnected from the first LC circuit of the first tank circuit; and cause the transceiver to be connected to the second LC circuit of the first tank circuit.

BRIEF DESCRIPTION OF THE DRAWINGS

The present solution will be described with reference to the following drawing figures, in which like numerals represent like items throughout the figures.

DETAILED DESCRIPTION

Figure 1:
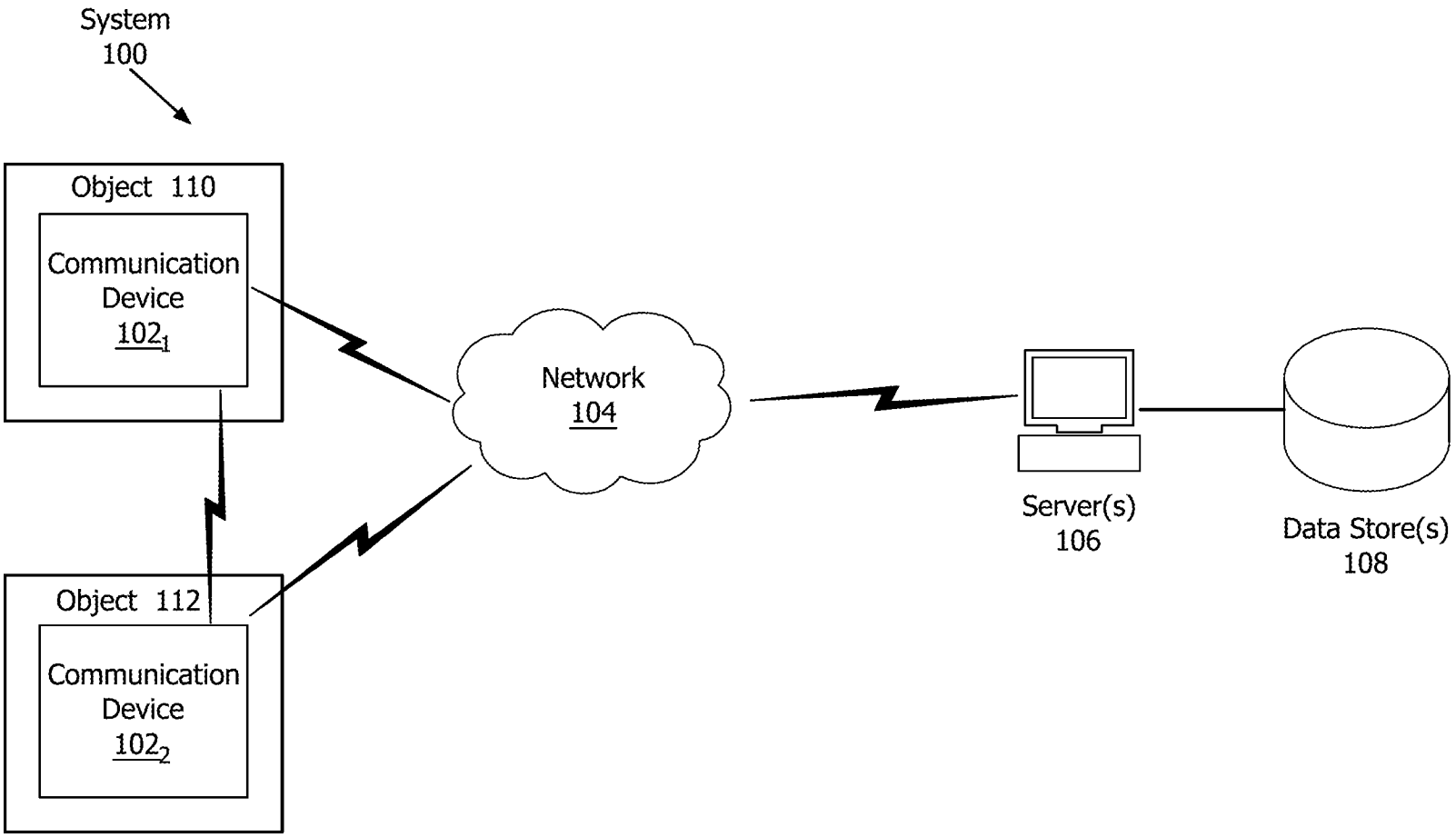
FIG. 1 is a perspective view of an illustrative system.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present solution may be embodied in other specific forms without departing from its spirit or essential characteristics. The described embodiments are to be considered in all respects only as illustrative and not restrictive. The scope of the present solution is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present solution should be or are in any single embodiment of the present solution. Rather, language referring to the features and advantages is understood to mean that a specific feature, advantage, or characteristic described in connection with an embodiment is included in at least one embodiment of the present solution. Thus, discussions of the features and advantages, and similar language, throughout the specification may, but do not necessarily, refer to the same embodiment.

Furthermore, the described features, advantages and characteristics of the present solution may be combined in any suitable manner in one or more embodiments. One skilled in the relevant art will recognize, in light of the description herein, that the present solution can be practiced without one or more of the specific features or advantages of a particular embodiment. In other instances, additional features and advantages may be recognized in certain embodiments that may not be present in all embodiments of the present solution.

Reference throughout this specification to "one embodiment", "an embodiment", or similar language means that a particular feature, structure, or characteristic described in connection with the indicated embodiment is included in at least one embodiment of the present solution. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

The present solution uses a programmable strip antenna for multi-band application, which is realized through carefully designing of the stacked antenna assembly. The radiating length of the antenna is controlled by the user to achieve a resonant frequency as well as bandwidth allocation and impedance matching. The resonant frequency of the antenna can be altered by changing the length (dipole or monopole) of the antenna element utilizing the following mathematical equation (1).

$$L = 0.49 * \frac{\lambda}{\sqrt{\varepsilon_r}} \quad (1)$$

where L represents a resonant length of a dipole antenna, λ represents a wave length in free space, and $\varepsilon_r$ represents a dielectric constant of a substrate material. The resonant frequency is also influenced with the grond plane dimension, substrate thickness and strip width (impedence matching).

The present solution is discussed herein in relation to communication systems for transmitting and receiving communication signals. The present solution is not limited in this regard. The present solution can be used in other applications such as Global Position System (GPS) applications, radio controlled clock applications, broadcast reception applications, satellite communication applications, telemetry applications, wireless transmission of RF power applications, radar application, electronic warfare application (e.g., sign jamming, electronic attack, electronic surveillance), and/or aviation communications.

Referring now to FIG. 1, there is provided a schematic illustration of an illustrative system 100 implementing the multi-band tunable strip antennas of the present solution. System 100 comprises a communication devices $\mathbf{102}_1, \ldots, \mathbf{102}_N$, a network 104, server(s) 106 and data store(s) 108. The communication devices $\mathbf{102}_1, \ldots, \mathbf{102}_N$ may be disposed on objects 110, 112. The objects can include, but are not limited to, vehicles (e.g., cars, trucks, boats, planes), satellites, and/or any other air/water/space communications platform. The communication devices 106 are configured to wirelessly communication directly with each other and/or with remote devices (e.g., server(s) 106) via the network 104. The network 104 includes, but is not limited to, the Internet, a cellular network, a radio network, a satellite communications network, and/or an aviation communications network. Each of the listed networks is well known in the art, and therefore will not be described herein.

Figure 2:
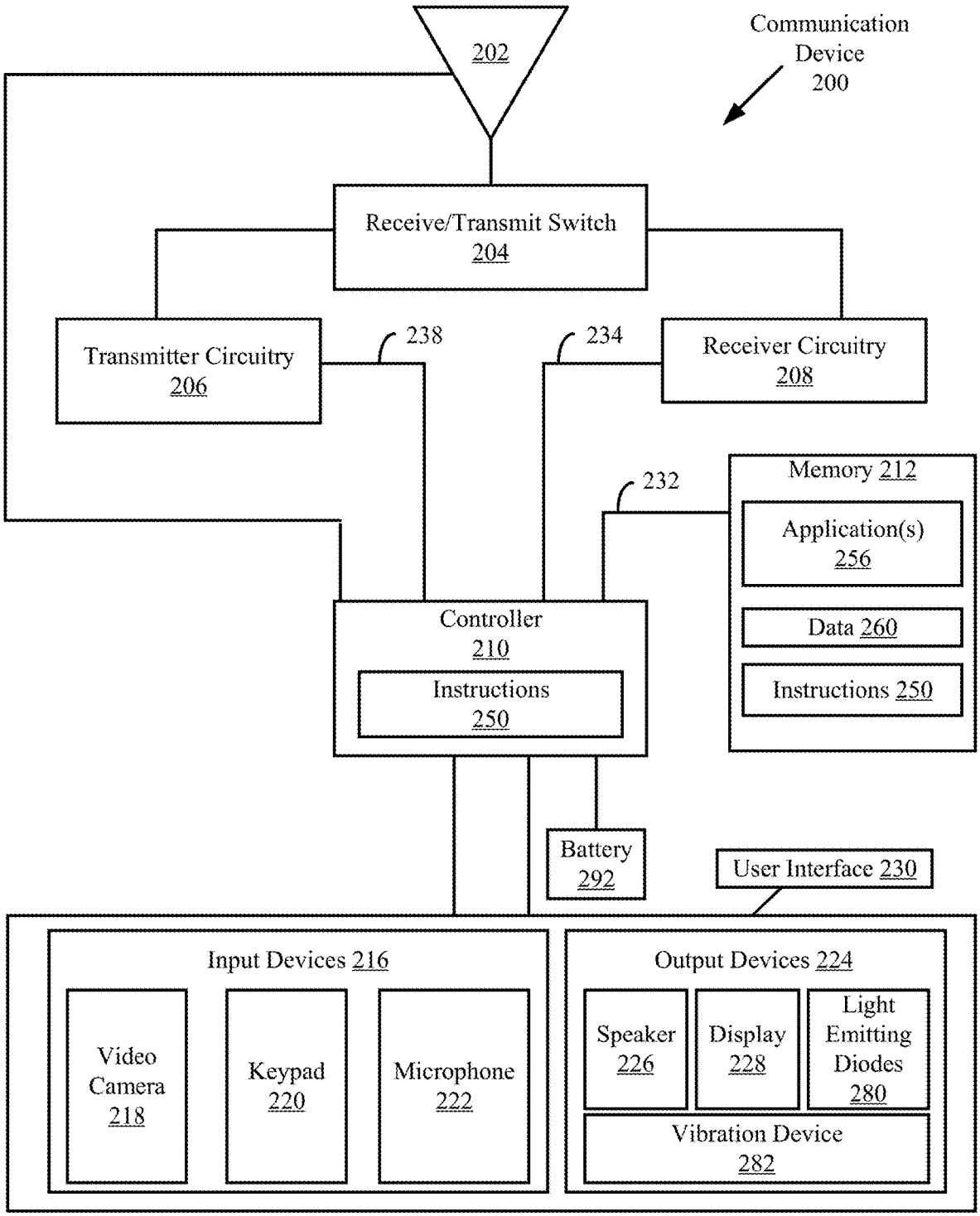
FIG. 2 is an illustration of an illustrative architecture for the communications device shown in FIG. 1.

Referring now to FIG. 2, there is provided a schematic illustration of an illustrative architecture for a communication device 200. Communication devices $\mathbf{102}_1, \ldots, \mathbf{102}_N$ of FIG. 1 are the same as or similar to communication device 200. As such, the discussion of communication device 200 is sufficient for understanding communication devices $\mathbf{102}_1, \ldots, \mathbf{102}_N$. The communication device 200 includes, but is not limited to, a satellite communications receiver, a radio, a cellular phone, a mobile phone, a smart phone, an aviation communication receiver, and/or a Navigation receiver (e.g., a Global Positioning System ("GPS") receiver or an eLoran receiver). Each of the listed devices is well known in the art, and therefore will not be described herein.

Communication device 200 may include more or less components than those shown in FIG. 2. However, the components shown are sufficient to disclose an illustrative embodiment implementing the present solution. Some or all of the components of the communication device 200 can be implemented in hardware, software and/or a combination of hardware and software. The hardware includes, but is not limited to, one or more electronic circuits.

Communication device 200 comprises an multi-band tunable strip antenna assembly 202 for receiving and transmitting signals. In some scenarios, the multi-band tunable strip antenna assembly 202 operates between 700 MHz and 200 GHz. The present solution is not limited to this operational frequency range. The operational bandwidth of the antenna 202 is adjustable through the user control of a tank circuit. The tank circuit will be discussed in detail below.

A receive/transmit ("Rx/Tx") switch 204 selectively couples the antenna assembly 202 to the transmitter circuitry 206 and the receiver circuitry 208 in a manner familiar to those skilled in the art. The receiver circuitry 208 demodulates and decodes the signals received from an external device. The receiver circuitry 208 is coupled to a controller (or microprocessor) 210 via an electrical connection 234. The receiver circuitry 208 provides the decoded signal information to the controller 210. The controller 210 uses the decoded signal information in accordance with the function(s) of the communication device 200. The controller 210 also provides information to the transmitter circuitry 206 for encoding and modulating information into signals. Accordingly, the controller 210 is coupled to the transmitter circuitry 206 via an electrical connection 238. The transmitter circuitry 206 communicates the signals to the antenna 202 for transmission to an external device via the Rx/Tx switch 204.

The controller 210 may store received and extracted information in memory 212 of the communication device 200. Accordingly, the memory 212 is connected to and accessible by the controller 210 through electrical connection 232. The memory 212 may be a volatile memory and/or a non-volatile memory. For example, memory 212 can include, but is not limited to, a Random Access Memory ("RAM"), a Dynamic Random Access Memory ("DRAM"), a Read Only Memory ("ROM") and a flash memory. The memory 212 may also comprise unsecure memory and/or secure memory. The memory 212 can be used to store various other types of data 260 therein, such as authentication information, cryptographic information, location information, and various object-related information (e.g., object identifier, operational states, etc.).

As shown in FIG. 2, one or more sets of instructions 250 are stored in memory 212. The instructions may include customizable instructions and non-customizable instructions. The instructions 250 can also reside, completely or at least partially, within the controller 210 during execution thereof by communication device 200. In this regard, the memory 212 and the controller 210 can constitute machine-readable media. The term "machine-readable media", as used herein, refers to a single medium or multiple media that stores one or more sets of instructions 250. The term "machine-readable media", as used here, also refers to any medium that is capable of storing, encoding or carrying the set of instructions 250 for execution by the communication device 200 and that causes the communication device 200 to perform one or more of the methodologies of the present disclosure.

The controller 210 is also connected to a user interface 230. The user interface 230 comprises input devices 216, output devices 224 and software routines (not shown in FIG. 2) configured to allow a user to interact with and control software applications (e.g., software applications 256 and other software applications) installed on communication device 200 and/or control switches (not shown in FIG. 2) of the multi-band tunable strip antenna assembly 202. The switches are selectively actuated by a user to set a frequency and/or bandwidth of the multi-band tunable strip antenna assembly 202. The manner in which the frequency and/or bandwidth are controller will become more evident as the discussion progresses.

The input and output devices may include, but are not limited to, a display 228, a speaker 226, a keypad 220, a directional pad (not shown in FIG. 2), a directional knob (not shown in FIG. 2), a microphone 222, and/or a video camera 218. The display 228 may be designed to accept touch screen inputs. As such, user interface 230 can facilitate a user software interaction for launching applications (e.g., software applications 256 and other software applications) installed on the communication device 200 and/or controlling electronic components and/or electro-mechanical components (e.g., switches) of the multi-band tunable strip antenna assembly 202. The application software 256 can facilitate the communication of information between the communication device 200 and an external device (e.g., another communications device or a remote server).

Notably, the multi-band tunable strip antenna assembly 202 comprises a novel multi-band tunable strip antenna architecture. Various multi-band tunable strip antenna assembly architecture will now be described in relation to FIGS. 3-8. The multi-band tunable strip antenna assembly 202 can be same as or substantially similar to the multi-band tunable strip antenna assemblies discussed below. As such, the discussion of the multi-band tunable strip antenna assembly architectures in relation to FIGS. 3-8 is sufficient for understanding the multi-band tunable strip antenna assembly 202.

Figure 3:
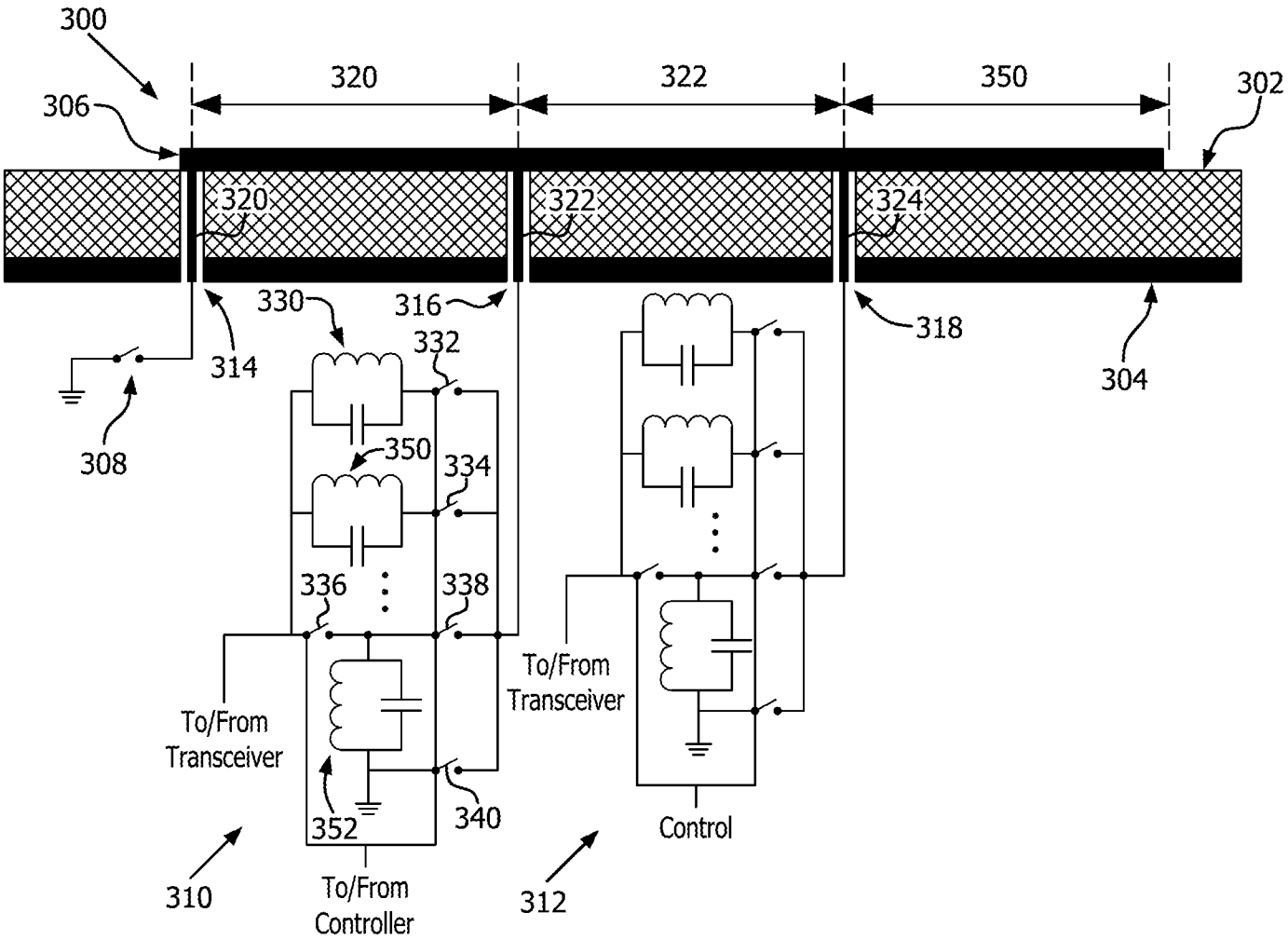
FIG. 3 is an illustration of an illustrative multi-band tunable strip antenna assembly.
Figure 4:
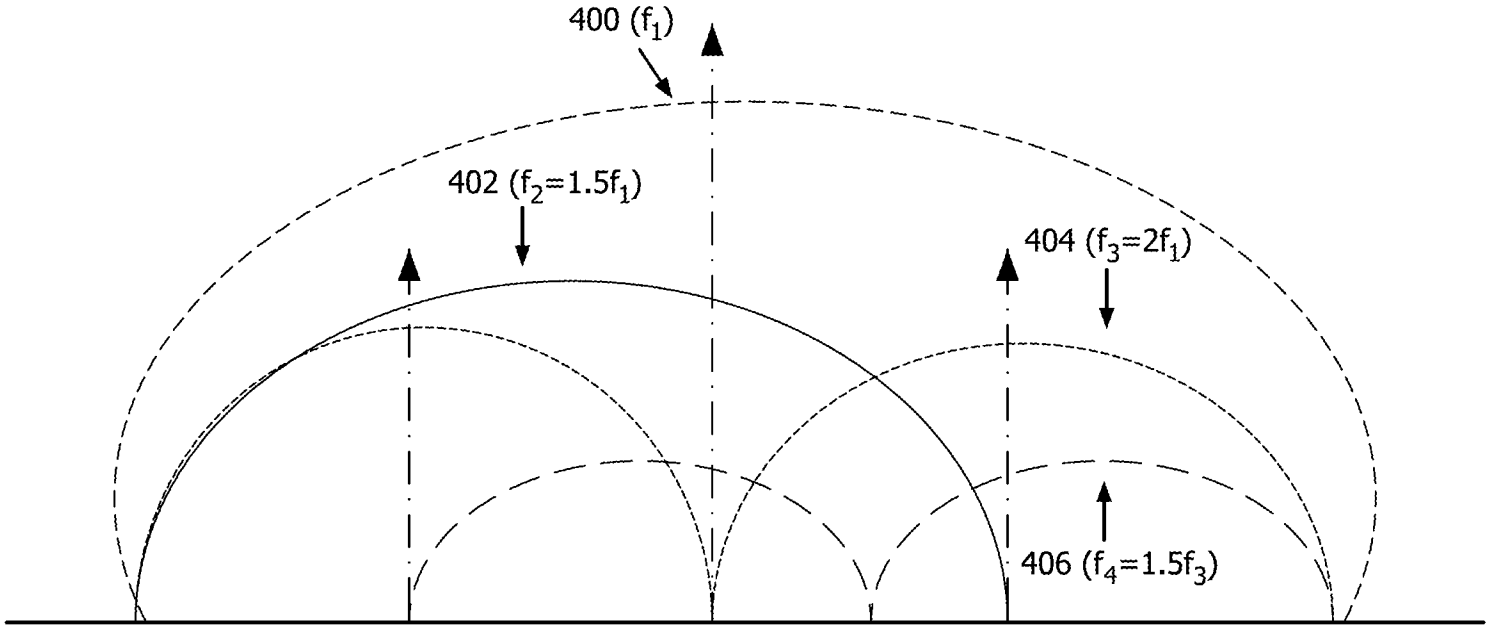
FIGS. 4 and 5 are graphs which are useful for understanding operations of the multi-band tunable strip antenna assembly shown in FIG. 3.

Referring now to FIG. 3, an illustrative architecture 300 for a multi-band tunable strip antenna assembly is shown. The antenna assembly 300 comprises a substrate 302 with a ground plane 304 and a strip antenna structure 306 disposed thereon. The substrate 302 can include an insulating material. The insulating material can include, but is not limited to, an FR-4 glass epoxy, a cotton paper impregnated with phenolic resin, and/or a plastic. The ground plane 304 is formed of a conductive material such as copper. The strip antenna structure 306 is also formed of a conductive material such as copper. The strip antenna structure 306 may comprise a trace that is printed or otherwise deposited on the substrate via, for example, a 3D printer. 3D printers are well known in the art.

Figure 7:
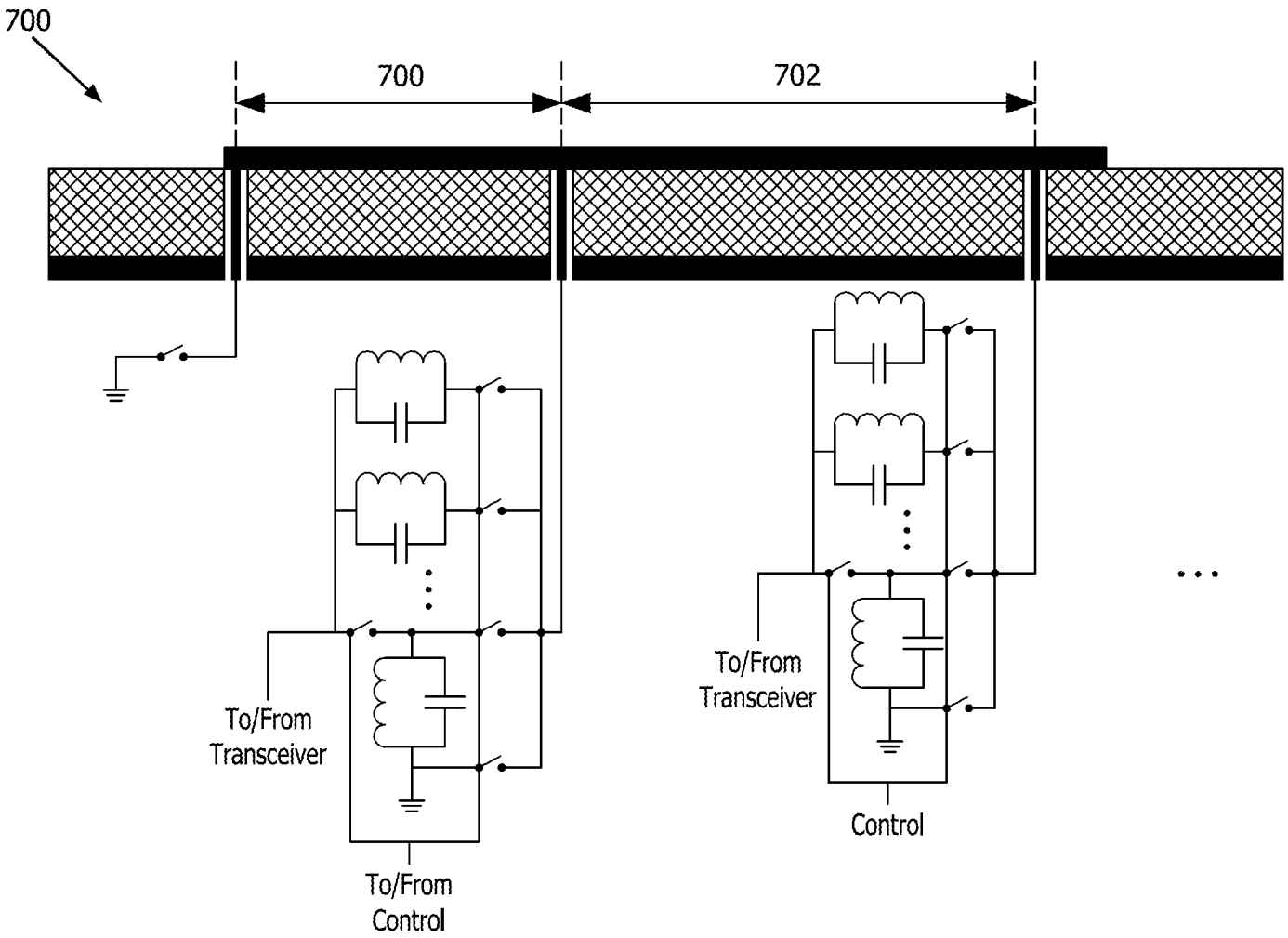
FIG. 7 is an illustration of another illustrative multi-band tunable strip antenna assembly.

A plurality of vias 314, 316, 318 are formed through the substrate 302. The vias can be equally spaced apart as shown in FIG. 3, or unequally spaced apart as shown in FIG. 7. In FIG. 3, the distances 320, 322, 350 between adjacent vias are equal to each other. In contrast, the distances 700 and 702 between adjacent vias in FIG. 7 are different than each other.

As shown in FIG. 3, conductive elements 320, 322, 324 are disposed in the vias so as to be electrically isolated from the ground plane 304. The conductive elements 320, 322, 324 electrically connect the strip antenna structure 306 to circuit components. More specifically, conductive element 320 electrically couples strip antenna structure 306 to a switch 308. Switch 308 can be selectively actuated to connect/disconnect the conductive element 320 to/from ground. Conductive element 322 electrically couples strip antenna structure 306 to a first tank circuit 310. Conductive element 324 electrically couples strip antenna structure 306 to a second tank circuit 312. Although two tank circuits are shown in FIG. 3, the present solution is not limited in this regard. Any number of tank circuits can be provided with the present solution in accordance with a given application.

Figure 5:
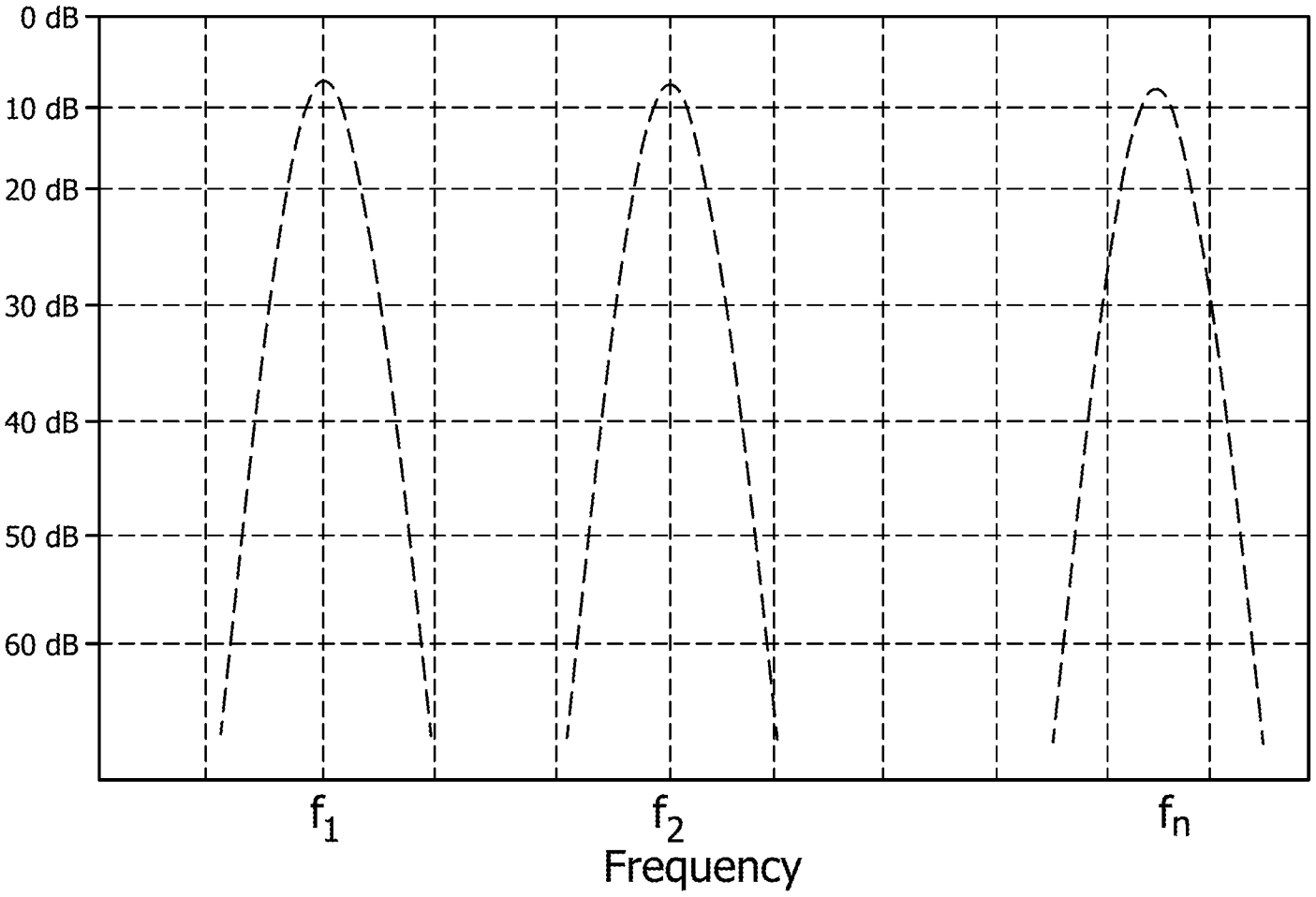
Figure 6A:
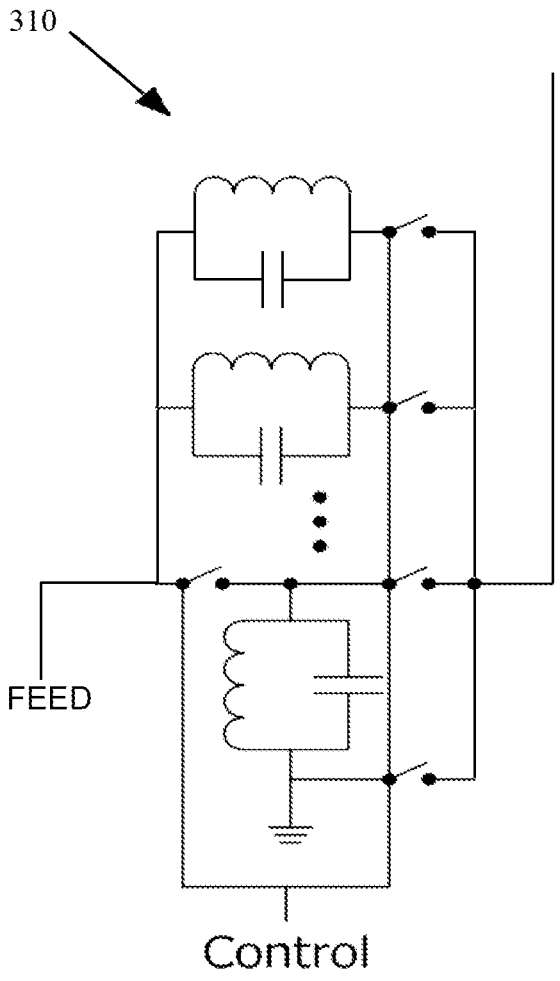
FIG. 6A is a schematic diagram showing a tank circuit used in FIG. 3.
Figure 6B:
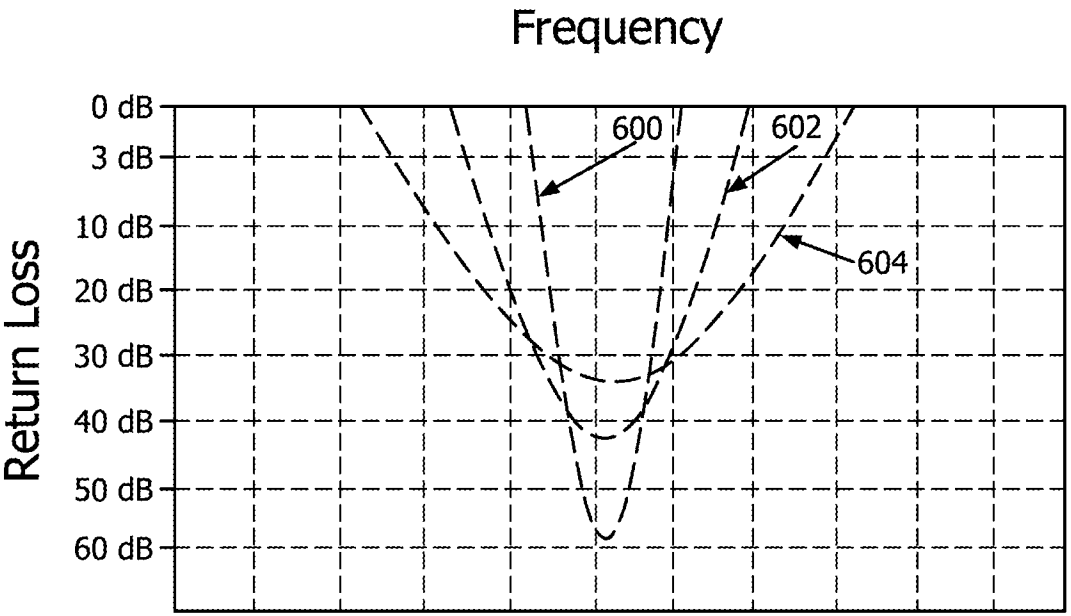
FIG. 6B is a graph which is useful for understanding operations of the multi-band tunable strip antenna assembly shown in FIG. 3.

The tank circuits 310, 312 are configured to facilitate user controlled selection/setting/tuning of a frequency for the strip antenna structure 306 at any given time. In this regard, each tank circuit is configured to cause operation of the strip antenna structure 306 at a given frequency. For example, as shown in the graph of FIG. 5, selection of a first tank circuit causes a strip antenna structure to operate at a first frequency $f_1$ (e.g., 700 MHz). Selection of second tank circuit causes the strip antenna structure to operate at a second frequency $f_2$ (e.g., 900 MHz). Selection of an $n^{th}$ tank circuit causes the strip antenna structure to operate at an $n^{th}$ frequency $f_n$ (e.g., 2 GHz). The present solution is not limited to the particulars of this example.

The tank circuits 310, 312 are also configured to facilitate user controlled selection/setting/tuning of a bandwidth for the strip antenna structure 306 at any given frequency. In this regard, each tank circuit comprises a plurality of circuits 330, 350, . . . , 352 respectively associated with different bandwidths to which the strip antenna 306 can be tuned. The circuits 330, 350, . . . , 352 can include, but are not limited to, LC circuits. Each LC circuit is configured to cause the strip antenna structure 306 to function at a respective bandwidth of a plurality of bandwidths. For example, as shown by line 600 in the graph of FIG. 6B, LC circuit 330 is configured to cause the strip antenna structure 306 to function at a first bandwidth (e.g., 35 MHz). As shown by line 602 of FIG. 6B, LC circuit 350 is configured to cause the strip antenna structure 306 to function at a second different bandwidth (40 MHz). As shown by line 604 of FIG. 6B, LC circuit 352 is configured to cause the strip antenna structure 306 to function at a third different bandwidth (e.g., 60 MHz). The present solution is not limited to the particulars of this example. The inductor and capacitor values of each LC circuit can be selected to provide any bandwidth selected in accordance with a given application.

Although three LC circuit/switch elements are shown in FIG. 3, the present solution is not limited in this regard. Each tank circuit can comprise any number of LC circuit/switch elements selected in accordance with a given application. Also, the tank circuits can include the same or different number of LC circuit/switch elements.

The LC circuits 330, 350, . . . , 352 are respectively connected to switches 332, 334, . . . , 340. Each of the switches is in a normally open position as shown in FIG. 3. Actuation of a given switch causes a transition thereof from an open position to a closed position, or vice versa. The opening/closing of the switches is controllable by a user via user-software interactions (e.g., via input devices 216 of FIG. 2 and/or via remote command signals). As such, the switches are shown in FIG. 3 as being electrically connected to a controller (e.g., controller 210 of FIG. 2).

In the closed position, switch 332 of tank circuit 310 electrically connects a transceiver (e.g., transceiver 204-208 of FIG. 2) to the strip antenna structure 306 via LC circuit 330 and conductive element 322. Similarly, in the closed position, switch 334 of tank circuit 310 electrically connects a transceiver (e.g., transceiver 204-208 of FIG. 2) to the strip antenna structure 306 via LC circuit 350 and conductive element 322. Likewise, in the closed positions, switches 336, 340 of tank circuit 310 electrically connects a transceiver (e.g., transceiver 204-208 of FIG. 2) to the strip antenna structure 306 via LC circuit 352 and conductive element 322. The switches 332, 334, 336, 340 of tank circuit 312 operate in the same or substantially similar manner to connect the transceiver (e.g., transceiver 204-208 of FIG. 2) to the strip antenna structure 306 via respective LC circuits and conductive element 324.

The transceiver can be connected directly to the strip antenna structure 306 via closure of switches 336, 338 of a given tank circuit (while switches 332, 334, 340 remain open). The strip antenna structure 306 can be coupled to ground via closure of switch 340 of each tank circuit (while switches 332-338 remain open).

During operation, the switches can be controlled to provide dipole antennas with given frequencies and/or bandwidths. For example, a first dipole antenna with a total length 320-322 can be provided between conductive elements 320, 324 when (i) a first end of the strip antenna structure 306 is connected to ground via switch 308, (ii) switch(es) of tank circuit 310 is(are) in its(their) closed position(s) so that the transceiver is connected to the strip antenna structure 306 via conductive element 322, and (iii) the conductive element 324 is connected to ground via switch 340 of tank circuit 312. An illustrative beam pattern for the dipole antenna element is shown by line 400 of FIG. 4. The bandwidth of the dipole antenna can be changed via the selective connection/disconnection of the LC circuits of the tank circuit 312 to/from the strip antenna structure 306. The dipole antenna has a first frequency of $f_1$.

A second dipole antenna with a total length of 320, 322, 350 can be provided when (i) a first end of the strip antenna structure 306 is connected to ground via switch 308, (ii) switch(es) of tank circuit 312 is(are) in its(their) closed position(s) so that the transceiver is connected to the strip antenna structure 306 via conductive element 322, and (iii) the conductive element 324 is not connected to the transceiver or ground via tank circuit 310. An illustrative beam pattern for the dipole antenna element is shown by line 402 of FIG. 4. The bandwidth of the dipole antenna can be changed via the selective connection/disconnection of the LC circuits of the tank circuit 312 to/from the strip antenna structure 306. The frequency of this dipole antenna is $f_2=1.5f_1$ since lengths 320, 322, 350 are equal.

A third dipole antenna with a frequency of $f_3=2f_1$ can also be provided via the circuit 300 of FIG. 3. This dipole antenna is provided when (i) a first end of the strip antenna structure 306 is not connected to ground via switch 308, (ii) the conductive element 322 is connected to ground via tank circuit 310, and (iii) the conductive element 324 is connected to the transceiver via tank circuit 312. An illustrative beam pattern for the dipole antenna element is shown by line 404 of FIG. 4. The bandwidth of the dipole antenna can be changed via the selective connection/disconnection of the LC circuits of the tank circuit 312 to/from the strip antenna structure 306.

A fourth dipole antenna with a frequency of $f_1=1.5f_3$ can also be provided via the circuit 300 of FIG. 3. This dipole antenna is provided by (i) a first end of the strip antenna structure 306 is connected to ground via switch 308, (ii) the conductive element 322 is not connected to the transceiver or ground via tank circuit 310, and (iii) the conductive element 324 is connected to the transceiver via tank circuit 312. An illustrative beam pattern for the dipole antenna element is shown by line 406 of FIG. 4. The bandwidth of the dipole antenna can be changed via the selective connection/disconnection of the LC circuits of the tank circuit 310 to/from the strip antenna structure 306.

Figure 8:
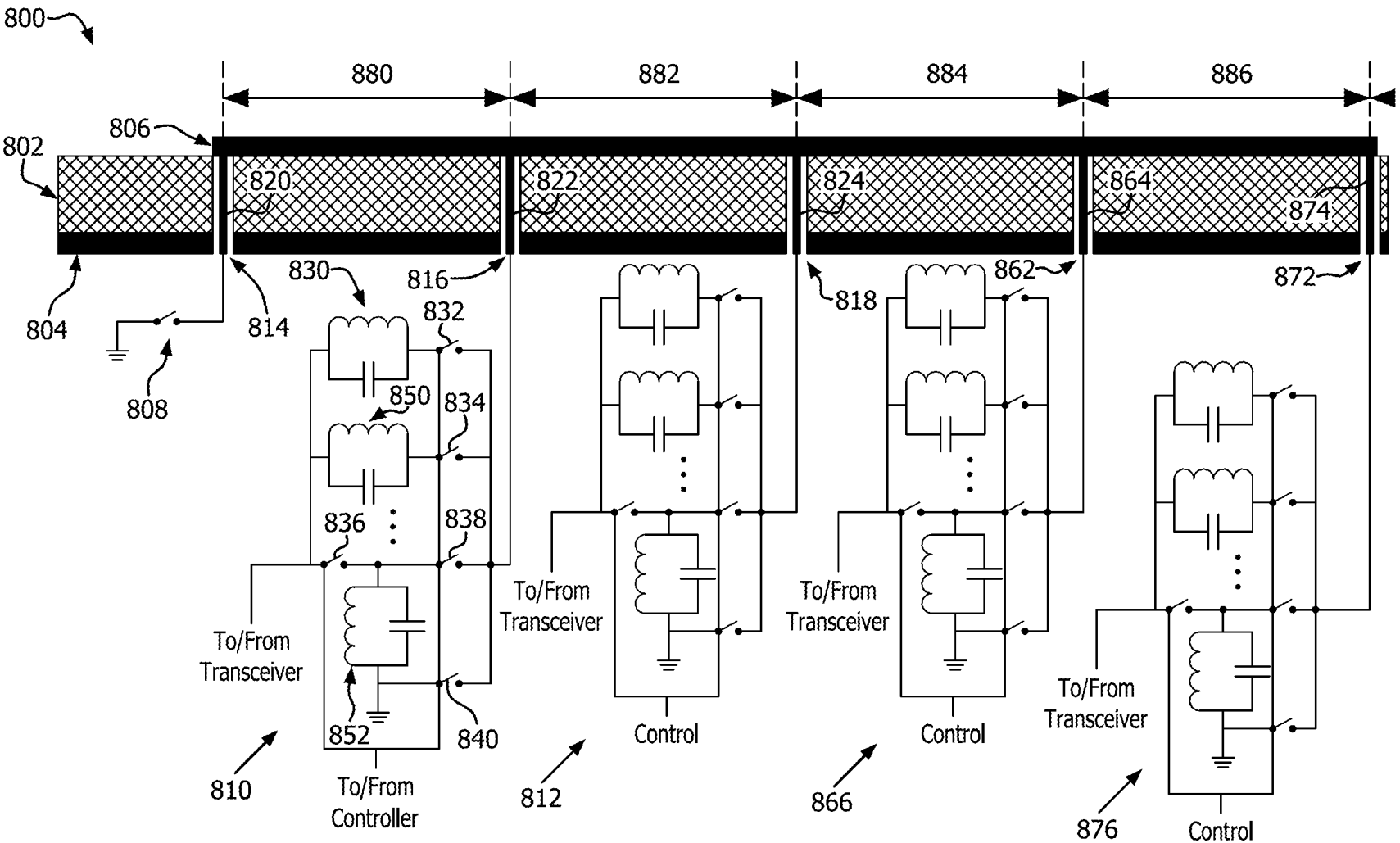
FIG. 8 is an illustration of another illustrative multi-band tunable strip antenna assembly.

Referring now to FIG. 8, another illustrative architecture 800 for a multi-band tunable strip antenna assembly is shown. The antenna assembly 800 comprises a substrate 802 with a ground plane 804 and a strip antenna structure 806 disposed thereon. The substrate 802 can include an insulating material. The insulating material can include, but is not limited to, an FR-4 glass epoxy, a cotton paper impregnated with phenolic resin, and/or a plastic. The ground plane 804 is formed of a conductive material such as copper. The strip antenna structure 806 is also formed of a conductive material such as copper. The strip antenna structure 806 may comprise a trace that is printed or otherwise deposited on the substrate via, for example, a 3D printer. 3D printers are well known in the art.

Figure 9A:
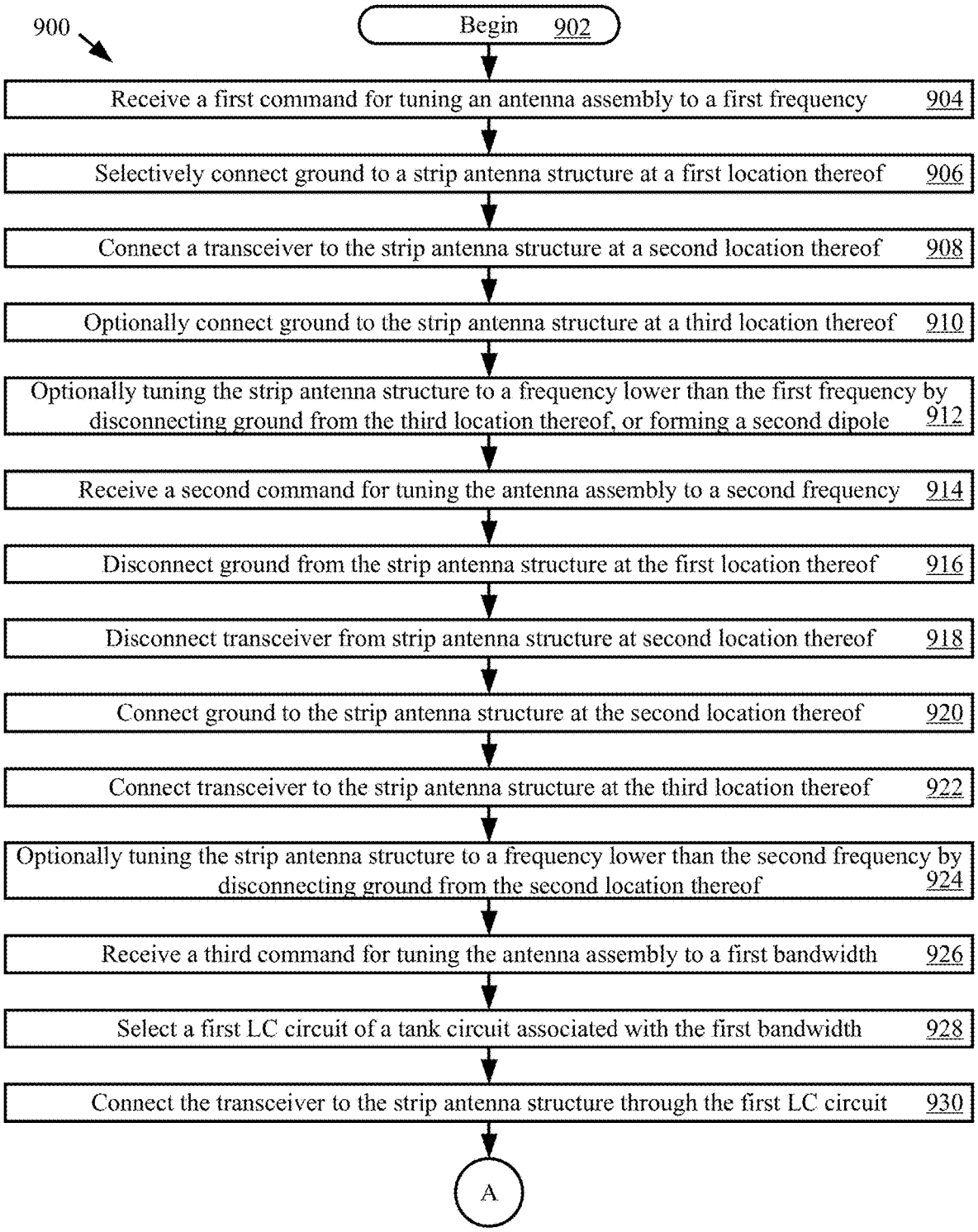
FIGS. 9A-9B (collectively referred to as "FIG. 9") is a method for operating a communications device.
Figure 9B:
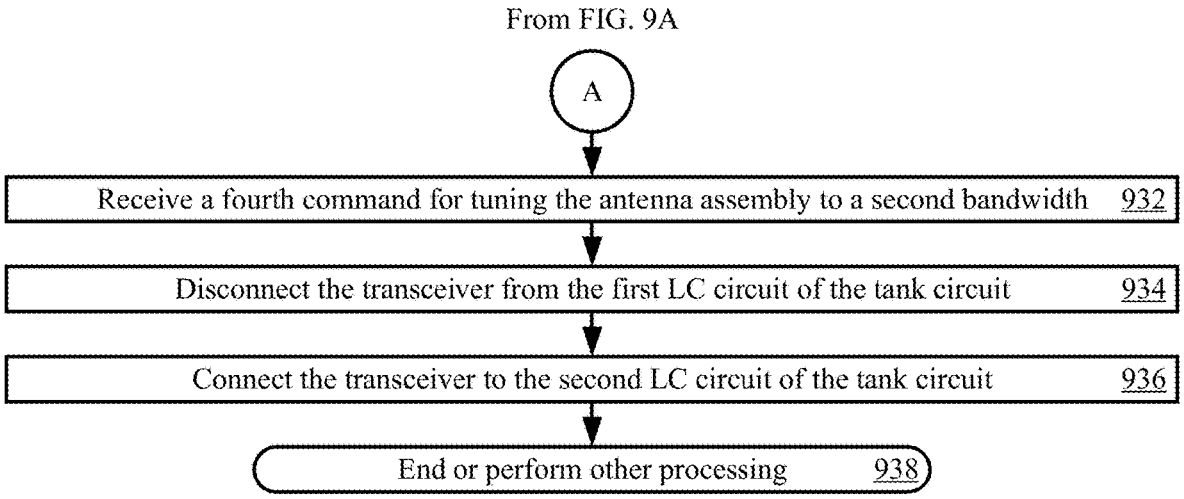

A plurality of vias 814, 816, 818, 862, 872 are formed through the substrate 802. The vias can be equally spaced apart as shown in FIG. 9, or unequally spaced apart. Conductive elements 820, 822, 824, 864, 874 are disposed in the vias so as to be electrically isolated from the ground plane 804. The conductive elements 820, 822, 824, 864, 874 electrically connect the strip antenna structure 806 to circuit components. More specifically, conductive element 820 electrically couples strip antenna structure 806 to a switch 808. Switch 808 can be selectively actuated to connect/disconnect the conductive element 820 to/from ground. Conductive element 822 electrically couples strip antenna structure 806 to a tack circuit 810. Conductive element 824 electrically couples strip antenna structure 806 to a tack circuit 812. Conductive element 864 electrically couples strip antenna structure 806 to a tack circuit 866. Conductive element 874 electrically couples strip antenna structure 806 to a tack circuit 876. Although four tank circuits are shown in FIG. 8, the present solution is not limited in this regard. Any number of tank circuits can be provided with the present solution in accordance with a given application.

The tank circuits 810, 812, 866, 876 are configured to facilitate user controlled selection/setting/tuning of a frequency for the strip antenna structure 806 at any given time. In this regard, each tank circuit is configured to cause operation of the strip antenna structure 806 at a given frequency. For example, selection of tank circuit 810 causes the strip antenna structure 806 to operate at a first frequency $f_1$ (e.g., 700 MHz). Selection of tank circuit 812 causes the strip antenna structure 806 to operate at a second frequency $f_2$ (e.g., 900 MHz). Selection of tank circuit 866 causes the strip antenna structure 806 to operate a third frequency $f_3$ (e.g., 2 GHz). Selection of tank circuit 876 causes the strip antenna structure 806 to operate a fourth frequency $f_4$ (e.g., 4 GHz). The present solution is not limited to the particulars of this example.

The tank circuits 810, 812, 866, 876 are also configured to facilitate user controlled selection/setting/tuning of a bandwidth for the strip antenna structure 806 at any given frequency. In this regard, each tank circuit comprises a plurality of LC circuits 830, 850, . . . , 852. Each LC circuit is configured to cause the strip antenna structure 806 to function at a respective bandwidth of a plurality of bandwidths. For example, LC circuit 830 is configured to cause the strip antenna structure 806 to function at a first bandwidth (e.g., 35 MHz). LC circuit 850 is configured to cause the strip antenna structure 806 to function at a second different bandwidth (40 MHz). LC circuit 852 is configured to cause the strip antenna structure 806 to function at a third different bandwidth (e.g., 60 MHz). The present solution is not limited to the particulars of this example. The inductor and capacitor values of each LC circuit can be selected to provide any bandwidth selected in accordance with a given application.

The LC circuits 830, 850, . . . , 852 are respectively connected to switches 832, 834, . . . , 840. Each of the switches is in a normally open position as shown in FIG. 8. Actuation of a given switch causes a transition thereof from an open position to a closed position, or vice versa. The opening/closing of the switches is controllable by a user via user-software interactions (e.g., via input devices 216 of FIG. 2 and/or via remote command signals). As such, the switches are shown in FIG. 8 as being electrically connected to a controller (e.g., controller 210 of FIG. 2).

In the closed position, switch 832 of tank circuit 810 electrically connects a transceiver (e.g., transceiver 204-208 of FIG. 2) to the strip antenna structure 806 via LC circuit 830 and conductive element 822. Similarly, in the closed position, switch 834 of tank circuit 810 electrically connects a transceiver (e.g., transceiver 204-208 of FIG. 2) to the strip antenna structure 806 via LC circuit 850 and conductive element 822. Likewise, in the closed positions, switches 836, 840 of tank circuit 810 electrically connect a transceiver (e.g., transceiver 204-208 of FIG. 2) to the strip antenna structure 806 via LC circuit 852 and conductive element 822. The switches 832, 834, 836, . . . , 852 of tank circuits 812, 866 operate in the same or similar manner to connect the transceiver (e.g., transceiver 204-208 of FIG. 2) to the strip antenna structure 806 via respective LC circuits and conductive elements 824, 864.

The transceiver can be connected directly to the strip antenna structure 806 via closure of switches 836, 838 of each tank circuit (while switches 832, 834, 840 remain open). The strip antenna structure 806 can be coupled to ground via closure of switch 840 of each tank circuit (while switches 832-838 remain open).

During operation, the switches of each tank circuit 810, 812, 866, 876 can be controlled to provide dipole antennas with given frequencies and/or bandwidths. The antenna(s) can have the same or different frequencies and/or bandwidths. For example, a dipole antenna with a total length of 880-882 can be provided between conductive elements 820, 824 when (i) a first end of the strip antenna structure 806 is connected to ground via switch 808, (ii) switch(es) of tank circuit 810 is(are) in its(their) closed position(s) so that the transceiver is connected to the strip antenna structure 806 via conductive element 822, and (iii) the conductive elements 824 is connected to ground. The bandwidth of the dipole antenna can be changed via the selective connection/disconnection of the LC circuits 830, 850, . . . , 852 of the tank circuit 810 to/from the strip antenna structure 806. The dipole antenna has a frequency of $f_1$.

Another dipole antenna with a length of 884-9886 can be created at the same time as the above-described dipole antenna with length 880-882 since the two sides of the strip antenna structure 806 are electrically isolated from each other via grounded conductive element 824. This dipole antenna is provided when (i) the conductive elements 824 is connected to ground, (ii) switch(es) of tank circuit 866 is(are) in its(their) closed position(s) so that the transceiver is connected to the strip antenna structure 806 via conductive element 864, and (iii) the conductive element 874 is not connected to ground (e.g., when the strip antenna structure 806 does not extend past the conductive element 874 as shown in FIG. 8) or is connected to ground (e.g., when the strip antenna structure 806 extends past the conductive element 874). The dipole antenna has a frequency of $f_2 \neq f_1$.

Another dipole antenna can be provided with a length of 880-886 and a frequency $f_3=2f_1$. This dipole antenna can be provided when (i) the conductive elements 824 is connected to ground via closure of switch 808, (ii) the conductive element 822 is not connected to the transceiver or ground via tank circuit 810, (iii) the conductive element 824 is connected to the transceiver via tank circuit 812, (iv) the conductive element 864 is not connected to the transceiver or ground via tank circuit 866, and (v) the conductive element 874 is not connected to ground (e.g., when the strip antenna structure 806 does not extend past the conductive element 874 as shown in FIG. 8) or is connected to ground (e.g., when the strip antenna structure 806 extends past the conductive element 874).

Another dipole antenna can be provided with a length of 880-884 and frequency $f_4=1.5f_1$. This dipole antenna is provided when (i) the conductive elements 820 is connected to ground via closure of switch 808, (ii) the conductive element 822 is connected to the transceiver via tank circuit 810, (iii) the conductive element 824 is not connected to the transceiver or ground via tank circuit 812, and (iv) the conductive element 864 is connected to ground via tank circuit 866.

Another dipole antenna can be provided with a length of 880-884 and frequency $f_5=1.5f_1$. This dipole antenna is provided when (i) the conductive elements 820 is connected to ground via closure of switch 808, (ii) the conductive element 822 is not connected to the transceiver or ground via tank circuit 810, (iii) the conductive element 824 is connected to the transceiver via tank circuit 812, and (iv) the conductive element 864 is connected to ground via tank circuit 866.

Another dipole antenna can be provide with a length of 882-886 and a frequency $f_6=1.5f_1$. This dipole antenna is provided when (i) the conductive elements 822 is connected to ground via tank circuit 810, (ii) the conductive element 824 is connected to the transceiver via tank circuit 812, (iii) the conductive element 864 is not connected to the transceiver or ground via tank circuit 866, and (iv) the conductive element 874 is or is not connected to ground via tank circuit 876 (e.g., depending on where the strip antenna structure 806 ends relative to the conductive element 874).

Another dipole antenna can be provided with a length 882-886 and a frequency $f_7=1.5f_2$. This dipole antenna is provided when (i) the conductive element 822 is connected to ground via tank circuit 810, (ii) the conductive element 824 is not connected to the transceiver or ground via 812, (iii) the conductive element 864 is connected to the transceiver via tank circuit 866, and (iv) the conductive element 874 is or is not connected to ground via tank circuit 876 (e.g., depending on where the strip antenna structure 806 ends relative to the conductive element 874).

Referring now to FIG. 9, there is provided a flow diagram of an illustrative method for operating an antenna assembly (e.g., antenna assembly 300 of FIG. 3, 700 of FIG. 7 or 800 of FIG. 8). Method 900 begins with 902 and continues with 904 where a first command is received by a controller (e.g., controller 210 of FIG. 2) of the antenna assembly. The first command is for tuning the antenna assembly to a first frequency selected from a plurality of different frequencies to which a strip antenna structure (e.g., strip antenna structure 306 of FIG. 3 or 806 of FIG. 8) of the antenna assembly is tunable. The strip antenna structure comprises a trace formed on a substrate (e.g., substrate 302 of FIG. 3 or 802 of FIG. 8). In response to the first command, ground is selectively connected to the strip antenna structure at a first location along an elongated length of the trace (e.g., a location aligned with conductive element 320 of FIG. 3 or 820 of FIG. 8), as shown by 906. A transceiver (e.g., transceiver 206, 208 of FIG. 2) is connected to the strip antenna structure at a second location thereof (e.g., a location aligned with conductive element 322 of FIG. 3 or 822 of FIG. 8), as shown by 908. This connection is made using a first tank circuit (e.g., tank circuit 310 of FIG. 3 or 810 of FIG. 8) of a plurality of tank circuits (e.g., tank circuits 310, 312 of FIG. 3 or 810, 812, 866, 876 of FIG. 8) provided with the antenna assembly. The tank circuits are respectively associated with the different frequencies to which the strip antenna structure is tunable. The first tank circuit is associated with the first frequency to which the strip antenna structure is to be tuned.

In 910, ground is optionally connected to the strip antenna structure at a third location along the elongated length of the trace (e.g., a location aligned with conductive element 324 of FIG. 3 or 824 of FIG. 8) by using a second tank circuit (e.g., tank circuit 312 of FIG. 3 or 812 of FIG. 8) of the plurality of tank circuits provided with the antenna assembly. The operations of 910 can be performed when the trace extends away from the third location in two opposing directions (e.g., as shown in FIG. 3 and FIG. 8). The frequency of the strip antenna structure can optionally be lowered by disconnecting ground from the third location along the elongated length of the trace, as shown by 912. Alternatively, a second dipole antenna can be formed using the singe strip antenna structure such that two dipole antennas exist at the same time. The second dipole antenna is formed by connecting the transceiver to the strip antenna structure at a fourth location (e.g., a location aligned with conductive element 864 of FIG. 8) along an elongated length of the trace.

In 914, the controller receives a second command for tuning the antenna assembly to a second frequency different from the first frequency. In response to the second command, operations of 916-922 are performed. 916-922 involve: disconnecting ground from the strip antenna structure at the first location along the elongated length of the trace; disconnecting the transceiver from the strip antenna structure at the second location along the elongated length of the trace; connecting ground to the strip antenna structure at the second location along the elongated length of the trace; and connecting the transceiver to the strip antenna structure at the third location along the elongated length of the trace using the second tank circuit. The frequency of the strip antenna structure can be optionally lowered as shown by 924. The frequency reduction can be achieved by disconnecting ground from the strip antenna structure at the second location thereof.

In 926, a third command is received by the controller of the antenna assembly. The third command is for tuning the antenna assembly to a first bandwidth. In response to the third command, the controller selects a first LC circuit (e.g., LC circuit 330 of FIG. 3 of 830 of FIG. 8) from a plurality of LC circuits (e.g., LC circuits 330, 350, 352 of FIG. 3 or 830, 850, 852 of FIG. 8) of a tank circuit based on the second command. The LC circuits are respectively associated with the different bandwidths to which the strip antenna structure is tunable at given frequency (e.g., the first or second frequency). The transceiver is then connected to the strip antenna structure through the first LC circuit, as shown by 930.

In 932, the controller receives a fourth command for tuning the antenna assembly to a second bandwidth selected from the plurality of bandwidths to which the strip antenna structure is tunable. The second bandwidth is different than the first bandwidth. Based on the contents of the fourth command, the controller selects a second LC circuit (e.g., LC circuit 350 of FIG. 3 or 850 of FIG. 8) from the plurality of LC circuits of the tank circuit. Next in 934, the transceiver is disconnected from the first LC circuit of the tank circuit. The transceiver is connected to the second LC circuit of the tank circuit in 936. Subsequently, 938 is performed where method 900 ends or other processing is performed.

Although the present solution has been illustrated and described with respect to one or more implementations, equivalent alterations and modifications will occur to others skilled in the art upon the reading and understanding of this specification and the annexed drawings. In addition, while a particular feature of the present solution may have been disclosed with respect to only one of several implementations, such feature may be combined with one or more other features of the other implementations as may be desired and advantageous for any given or particular application. Thus, the breadth and scope of the present solution should not be limited by any of the above described embodiments. Rather, the scope of the present solution should be defined in accordance with the following claims and their equivalents.

What is claimed is:

1. A method for operating an antenna assembly, comprising: receiving a first command for tuning the antenna assembly to exhibit a resonant response at a first frequency selected from a plurality of different frequencies at which a strip antenna structure of the antenna assembly can be caused to exhibit the resonant response, the strip antenna structure comprising a trace formed on a substrate; responsive to the first command, changing an effective length of the strip antenna structure to automatically transition the antenna assembly to exhibit the resonant response at the first frequency by using a first switch to selectively connect a ground to the strip antenna structure at a first location along an elongated length of the trace; and responsive to the first command, connecting a transceiver to the strip antenna structure at a second location along the elongated length of the trace using a first tank circuit selected from a plurality of tank circuits provided with the antenna assembly; wherein the plurality of tank circuits are respectively associated with the plurality of different frequencies at which the strip antenna structure can be made to exhibit the resonant response, and the first tank circuit is associated with the first frequency at which the strip antenna structure exhibits the resonant response.

2. The method according to claim 1, wherein the changing of the effective length of the strip antenna further comprises connecting the ground to the strip antenna structure at a third location along the elongated length of the trace by using a second switch associated with a second tank circuit of the plurality of tank circuits provided with the antenna assembly.

3. The method according to claim 2, wherein the trace extends away from the third location in two opposing directions.

4. The method according to claim 2, further comprising changing of the effective length of the strip antenna to tune the strip antenna structure to exhibit the resonant response at a second frequency lower than the first frequency by disconnecting the ground from the third location along the elongated length of the trace.

5. The method according to claim 2, further comprising connecting the transceiver to the strip antenna structure at a fourth location along the elongated length of the trace so as to simultaneously provide two dipole antennas using a single trace formed on the substrate.

6. The method according to claim 1, further comprising tuning the strip antenna structure to exhibit the resonant response at a second frequency selected from the plurality of different frequencies to which the strip antenna structure is tunable by: further changing the effective length of the strip antenna by using the first switch to disconnecting the ground from the strip antenna structure at the first location along the elongated length of the trace; disconnecting the transceiver from the strip antenna structure at the second location along the elongated length of the trace; connecting the ground to the strip antenna structure at the second location along the elongated length of the trace; and connecting the transceiver to the strip antenna structure at a third location along the elongated length of the trace using a second tank circuit of the plurality of tank circuits.

7. The method according to claim 6, further comprising changing the effective length of the strip antenna by tuning the strip antenna structure to exhibit the resonant response at a third frequency lower than the second frequency by disconnecting the ground from the strip antenna structure at the second location along the elongated length of the trace.

8. The method according to claim 1, further comprising:

receiving a second command for tuning the antenna assembly to a first bandwidth selected from a plurality of different bandwidths to which the strip antenna structure is tunable; and selecting a first LC circuit from a plurality of LC circuits of the first tank circuit based on the second command, the plurality of LC circuits of the first tank circuit being associated with the plurality of different bandwidths to which the strip antenna structure is tunable.

9. The method according to claim 8, wherein the transceiver is connected to the strip antenna structure at the second location along the elongated length of the trace through the first LC circuit of the first tank circuit.

10. The method according to claim 9, further comprising:

receiving a third command for tuning the antenna assembly to a second bandwidth selected from the plurality of bandwidths to which the strip antenna structure is tunable;

selecting a second LC circuit from the plurality of LC circuits of the first tank circuit based on the third command;

disconnecting the transceiver from the first LC circuit of the first tank circuit; and connecting the transceiver to the second LC circuit of the first tank circuit.

11. The method according to claim 1, wherein the plurality of tank circuits comprise a plurality of selectable subcircuits respectively associated with different bandwidths to which the strip antenna structure is tunable.

12. A system, comprising: an antenna assembly comprising: a substrate with a plurality of vias formed therein; a strip antenna structure comprising a trace disposed on a first surface of the substrate; a ground layer disposed on a second opposing surface of the substrate; and a plurality of conductive elements extending through the vias of the substrate so as to be respectively coupled between the trace and a plurality of tank circuits; and a control circuit configured to: receive a first command for tuning the antenna assembly to exhibit a resonant response at a first frequency selected from a plurality of different frequencies teat which the strip antenna structure can be caused to exhibit the resonant response; automatically transition the antenna assembly to exhibit the resonant response at the first frequency by selectively causing the ground layer to be connected to the strip antenna structure at a first location along an elongated length of the trace, responsive to the first command; and cause a transceiver to be connected to the strip antenna structure at a second location along the elongated length of the trace via a first tank circuit selected from the plurality of tank circuits, responsive to the first command; wherein the plurality of tank circuits are respectively associated with the plurality of different frequencies teat which the strip antenna structure can be caused to exhibit the resonant response, and the first tank circuit is associated with the first frequency a which the strip antenna structure can be caused to exhibit the resonant response.

13. The system according to claim 12, wherein the control circuit is further configured to cause the ground layer to be connected to the strip antenna structure at a third location along the elongated length of the trace via a second tank circuit of the plurality of tank circuits.

14. The system according to claim 13, wherein the trace extends away from the third location in two opposing directions.

15. The system according to claim 13, wherein the controller is further configured to tune the strip antenna structure to exhibit the resonant response at a second frequency lower than the first frequency by causing the ground layer to be disconnected from the third location along the elongated length of the trace.

16. The system according to claim 13, wherein the controller is further configured to cause the transceiver to be connected to the strip antenna structure at a fourth location along the elongated length of the trace so as to simultaneously provide two dipole antennas using a single trace formed on the substrate.

17. The system according to claim 12, the controller is further configured to tune the strip antenna structure to exhibit the resonant response at a second frequency selected from the plurality of different frequencies teat which the strip antenna structure can be caused to exhibit the resonant response by causing: the ground layer to be disconnected from the strip antenna structure at the first location along the elongated length of the trace; the transceiver to be disconnected from the strip antenna structure at the second location along the elongated length of the trace; the ground layer to be connected to the strip antenna structure at the second location along the elongated length of the trace; and the transceiver to be connected to the strip antenna structure at a third location along the elongated length of the trace using a second tank circuit of the plurality of tank circuits.

18. The system according to claim 17, wherein the controller is further configured to tune the strip antenna structure to exhibit the resonant response at a third frequency lower than the second frequency by causing the ground layer to be disconnected from the strip antenna structure at the second location along the elongated length of the trace.

19. The system according to claim 12, the controller is further configured to:

receive a second command for tuning the antenna assembly to a first bandwidth selected from a plurality of different bandwidths to which the strip antenna structure is tunable; and select a first LC circuit from a plurality of LC circuits of the first tank circuit based on the second command, the plurality of LC circuits of the first tank circuit being associated with the plurality of different bandwidths to which the strip antenna structure is tunable.

20. The system according to claim 19, wherein the transceiver is connected to the strip antenna structure at the second location along the elongated length of the trace through the first LC circuit of the first tank circuit.

21. The system according to claim 20, wherein the controller is further configured to:

receive a third command for tuning the antenna assembly to a second bandwidth selected from the plurality of bandwidths to which the strip antenna structure is tunable;

select a second LC circuit from the plurality of LC circuits of the first tank circuit based on the third command;

cause the transceiver to be disconnected from the first LC circuit of the first tank circuit; and cause the transceiver to be connected to the second LC circuit of the first tank circuit.

* * * * *